US006298766B1

(12) United States Patent
Mor

(10) Patent No.: US 6,298,766 B1
(45) Date of Patent: Oct. 9, 2001

(54) BLAST PROTECTION OF CURTAIN WALLS

(76) Inventor: Uzi Mor, 16 Eli Cohen Street, Herzliya 46480 (IL)

( * ) Notice: Subject to any disclaimer, the term of this patent is extended or adjusted under 35 U.S.C. 154(b) by 0 days.

(21) Appl. No.: 09/283,344

(22) Filed: Mar. 31, 1999

(30) Foreign Application Priority Data

May 10, 1998 (IL) ..... 124403

(51) Int. Cl.[7] ..... F41H 5/24; E06B 1/04

(52) U.S. Cl. ..... 89/36.04; 89/36.01; 52/203

(58) Field of Search ..... 89/36.04, 36.01, 89/36.14; 52/203, 202; 160/172 V, 176.1 V, 168.1 V, 184, 332

(56) References Cited

U.S. PATENT DOCUMENTS 1,858,801 * 5/1932 Bolard ..... 160/172 V
2,768,679 * 10/1956 Kiefer ..... 160/172 V
3,671,370 * 6/1972 Littel, Jr. ..... 89/36.04
4,061,093 12/1977 Carstens, Jr. et al. .
4,625,468 12/1986 Hampel .
5,127,204 7/1992 Braun .
5,427,169 * 6/1995 Saulters ..... 160/368.1
5,454,414 * 10/1995 Colson et al. ..... 160/84.02
5,939,658 * 8/1999 Muller ..... 89/36.04

FOREIGN PATENT DOCUMENTS

WO 95/18277 7/1995 (FR) .

* cited by examiner

*Primary Examiner*—Charles T. Jordan
*Assistant Examiner*—Judith A. Nelson
(74) *Attorney, Agent, or Firm*—McDonnell Boehnen Hulbert & Berghoff

(57) ABSTRACT

Protective apparatus including a plurality of spaced, slender tensile elements installed in a room inwards of a glass panel of a curtain wall of the room, wherein when the glass panel is destroyed by an explosive blast, the tensile elements generally prevent fragments from the glass panel from flying inwards past the tensile elements.

9 Claims, 2 Drawing Sheets

BLAST PROTECTION OF CURTAIN WALLS

FIELD OF THE INVENTION

The present invention relates generally to protection of windows and so-called curtain walls, i.e., glass facades, against effects of blasts and explosions.

BACKGROUND OF THE INVENTION

Many office and public buildings today are constructed with so called external curtain walls, i.e., large glass facades. Although such structures are aesthetically pleasing and very architecturally attractive, protecting such buildings from conventional bomb attack as well as chemical and biological attack poses an enormous challenge. A standard curtain wall exposed to a bomb blast instantly becomes a source of flying debris of sharp shards which are often more deadly than the bomb blast itself.

Window panes made of coated or laminated glass are known to stand up significantly better than regular glass panes to the effects of bomb blasts, but nevertheless these types of window panes do have a threshold beyond which they too shatter and become a source of flying sharp debris.

SUMMARY OF THE INVENTION

The present invention seeks to provide apparatus and methods for protecting windows and curtain walls against effects of blasts and explosions.

The present invention comprises placing a protective manner structure of cables, mesh, pipes and the like inwards of the glass panels of the window or curtain wall. The inner protective cable structure preferably does not contact the window or curtain wall, but rather is separated a small distance from the internal surfaces of the window or curtain wall The protective cables are basically anchored to the floor and ceiling, but may also be anchored at some points to other, non-curtain walls of the room. The protective cables vent the blast while at the same time act as a barrier against flying shards by means of tensile forces in the cables.

It is noted that throughout the description and claims the terms "window" and "curtain wall" are used interchangeably.

There is thus provided in accordance with a preferred embodiment of the present invention protective apparatus including a plurality of spaced, slender tensile elements installed in a room inwards of a glass panel of a window of the room, wherein when the glass panel is destroyed by an explosive blast, the tensile elements generally prevent fragments from the glass panel from flying inwards past the tensile elements.

In accordance with a preferred embodiment of the present invention the tensile elements do not contact the window of the room, but rather are separated a small distance from internal surfaces of the window of the room.

Further in accordance with a preferred embodiment of the present invention the tensile elements are anchored to at least one of a floor and a ceiling of the room.

Still further in accordance with a preferred embodiment of the present invention at least one of the tensile elements is anchored to a wall of the room which does not include glass. The tensile elements may include cables, mesh, pipes, rods and/or bars.

In accordance with a preferred embodiment of the present invention the tensile elements are generally mutually parallel. Alternatively at least one of the tensile elements may be non-parallel to another tensile element.

Further in accordance with a preferred embodiment of the present invention the tensile elements are wrapped around a mounting bar which is fixedly attached to at least one of a floor and a ceiling of the room.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1B:
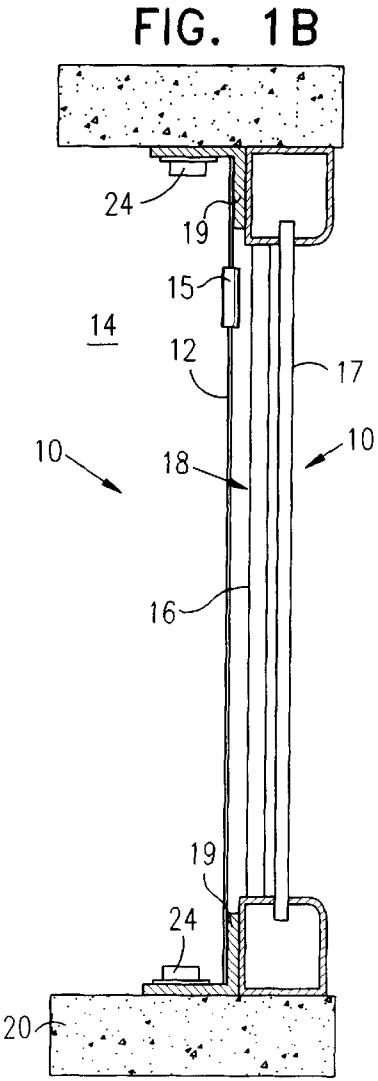
FIGS. 1A and 1B are simplified front view and side view illustrations, respectively, of protective apparatus for a curtain wall constructed and operative in accordance with a preferred embodiment of the present invention.
Figure 1A:
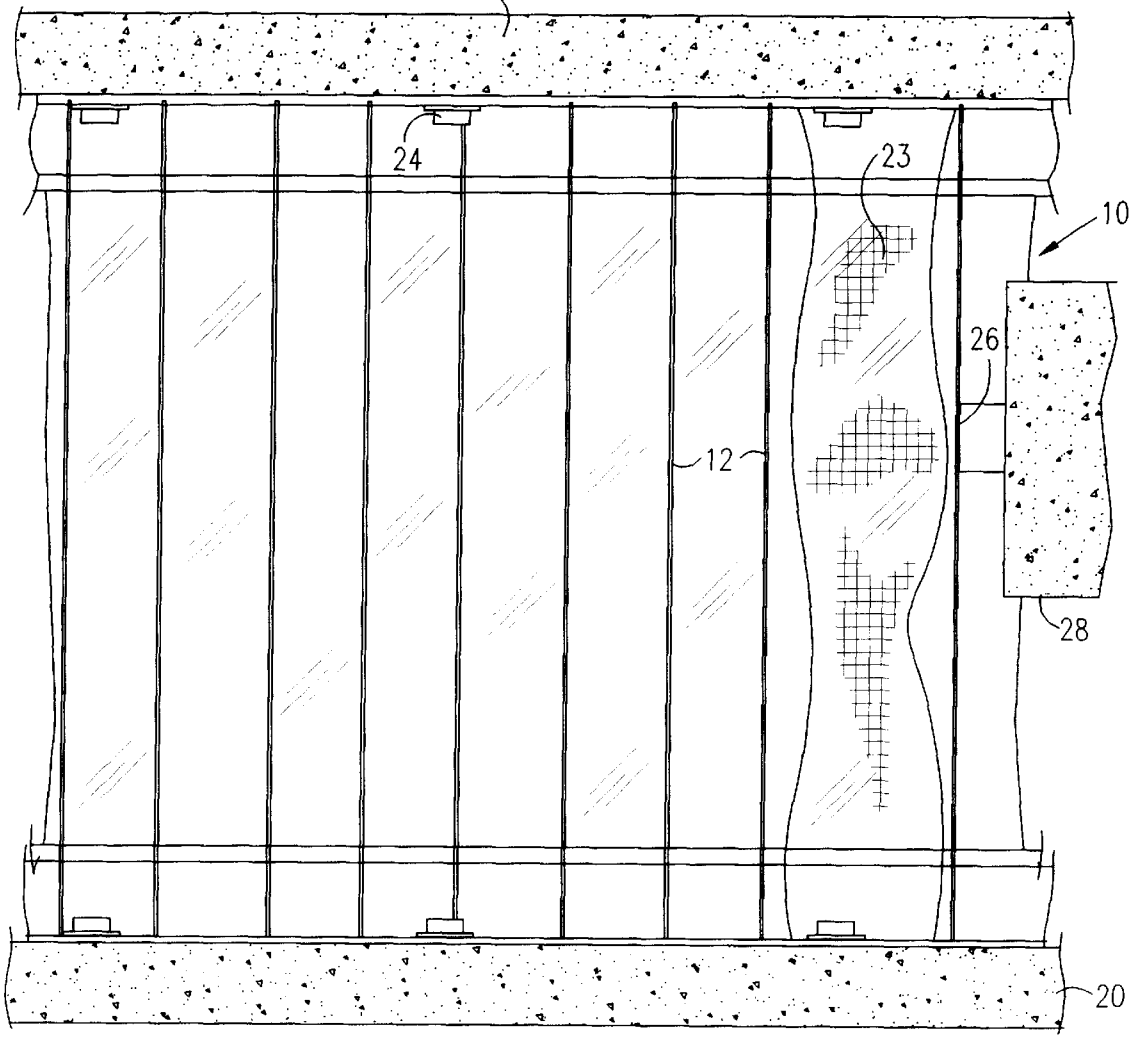

Reference is now made to FIGS. 1A and 1B which illustrate protective apparatus 10 constructed and operative in accordance with a preferred embodiment of the present invention. Protective apparatus 10 preferably includes a plurality of spaced, slender tensile elements 12 installed in a room 14 inwards of a glass panel 16 of a curtain wall 18. Curtain wall 18 may be provided with a shutter 17. It is seen that preferably tensile elements 12 do not contact curtain wall 18 or any other wall of room 14, but rather are separated a small distance from internal surfaces of curtain wall 18.

Tensile elements 12 may include cables, pipes, rods and bars, or any other kind of slender mechanical element. As seen in FIG. 1A, tensile elements 12 may be generally mutually parallel. Tensile elements 12 may or may not be equally spaced from each other. Tensile elements 12 may include non-parallel portions. For example, as seen in FIG. 1A, tensile elements 12 may alternatively or additionally comprise a mesh 23, wherein the tensile elements are arranged like the warp and weft of a woven fabric. Tensile elements 12 may be constructed of metal, plastic, metal coated with plastic, aramid fiber or any other material suitable for obstructing passage therethrough of flying shards and debris, and for withstanding blast forces as defined in applicable blast protection requirements of local building codes.

In any case, the spacing between tensile elements 12 is selected so that the elements obstruct passage therethrough of flying shards and debris. For example, if curtain wall 18 is constructed of coated or laminated glass, it may be sufficient to space tensile elements 12 from 20 to 50 cm apart For non-laminated glass, the spacing may range from a few millimeters to a few centimeters.

As seen in FIG. 1B, one preferred method of installing tensile elements 12 includes anchoring brackets 19 to a floor 20 and/or a ceiling 22, such as by means of bolts or molly bolts 24 with large-size washers to provide high bearing strength against explosive forces. Tensile elements 12 are attached to brackets 19, such as by mechanical fasteners or by welding. In addition to attachment to floor 20 and/or ceiling 22, one or more tensile elements 12 may also be anchored to some point 26 along a non-curtain wall 28 of room 14. Optionally, as seen in FIG. 1B, a tensioner 15 may be installed on one or more of the tensile elements 12 to adjust the tension of the tensile element.

Figure 2B:
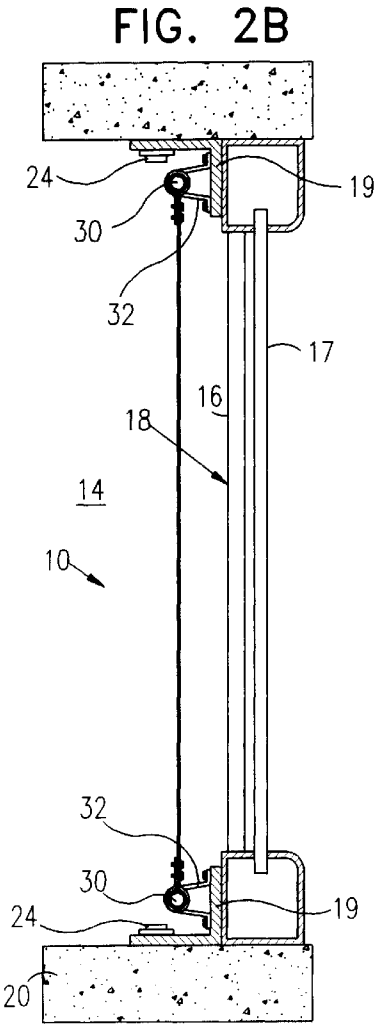
FIGS. 2A and 2B are simplified front view and side view illustrations, respectively, of the protective apparatus of FIGS. 1A and 1B, wherein tensile elements are wrapped around mounting bars in accordance with another preferred embodiment of the present invention.
Figure 2A:
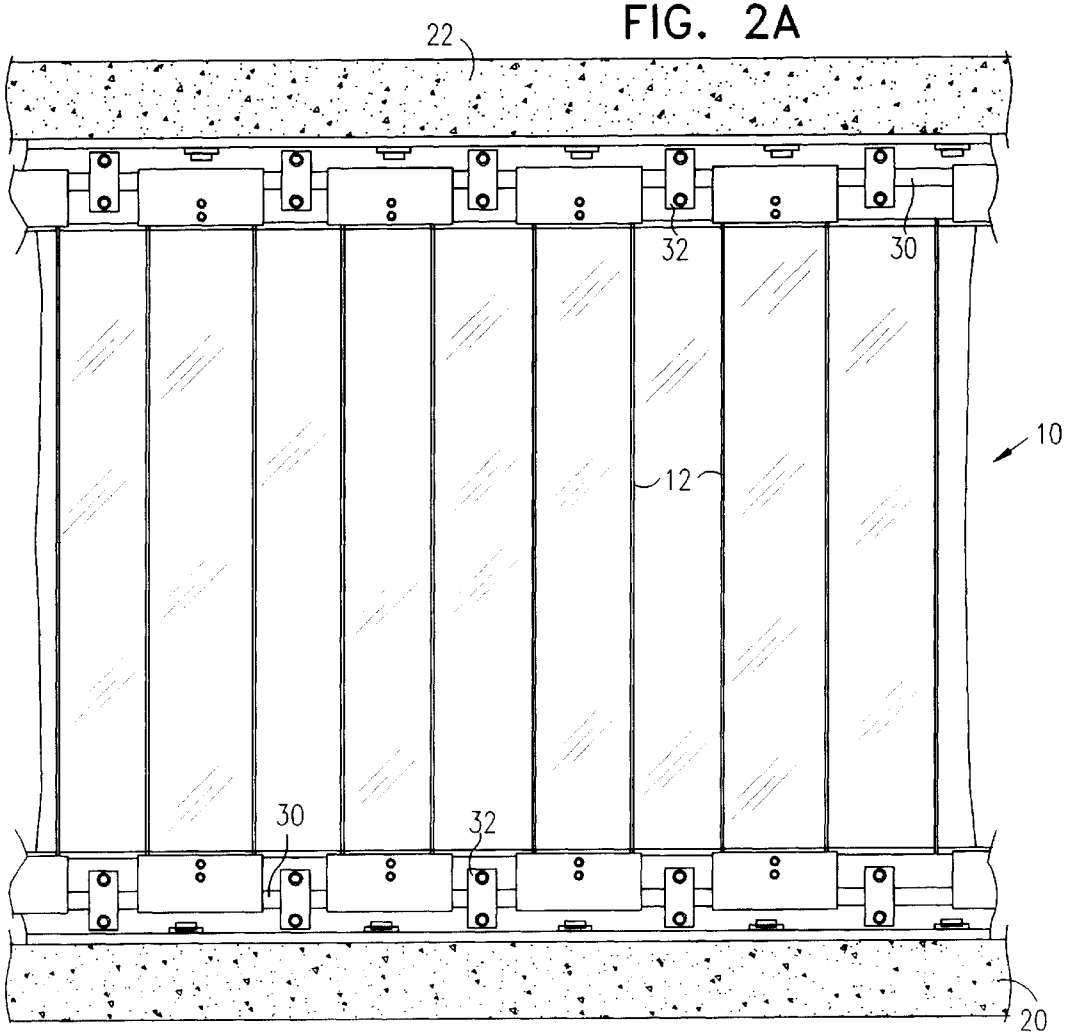

Reference is now made to FIGS. 2A and 2B which illustrate protective apparatus 10 attached to floor 20 and/or ceiling 22 in accordance with another preferred embodiment of the present invention. In this embodiment, tensile elements 12 are wrapped around mounting bars 30 which are fixedly attached to brackets 19 by means of additional brackets 32.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A room protection system comprising:

at least one stationary tensile element installed in a room inwardly of a glass panel of the room; and a tensioner associated with said at least one stationary tensile element, wherein when said glass panel is destroyed by an explosive blast, said at least one tensile element generally prevent fragments from said glass panel from flying inwards past said at least one tensile element.

2. The system according to claim 1 and wherein said at least one tensile element does not contact the glass panel, bur rather is separated therefrom.

3. The system according to claim 1 and wherein said at least one tensile element are is anchored to at least one of a floor and a ceiling of said room.

4. The system according to claim 1 and wherein said at least one tensile element is anchored to a non-curtain wall of said room.

5. The system according to claim 1 and wherein said at least one tensile element are is selected from the group consisting of cables, mesh, pipes, rods and bars.

6. The system according to claim 1 wherein said at least one tensile element comprises a plurality of tensile elements which are generally mutually parallel.

7. A system according to claim 6 wherein at least one of said plurality of tensile elements is not parallel to another of said plurality of tensile elements.

8. The system according to claim 1 wherein said at least one tensile element is wrapped around a mounting bar which is fixedly attached to at least one of a floor and a ceiling of said room.

9. A room protection system comprising:

at least one glass panel which is formed with at least one of a coating and a lamination;

at least one stationary tensile element installed inwardly of said glass panel, wherein when said glass panel which is formed with at least one of a coating and a lamination is destroyed by an explosive blast, said at least one tensile element generally prevent fragments from said glass panel from flying inwardly into a room past said at least one tensile element.

* * * * *